US009682832B2

(12) United States Patent
Kuroki et al.

(10) Patent No.: US 9,682,832 B2
(45) Date of Patent: Jun. 20, 2017

(54) SHEET FEED CASSETTE AND IMAGE FORMING APPARATUS

(71) Applicant: KYOCERA Document Solutions Inc., Osaka-shi, Osaka (JP)

(72) Inventors: Hirofumi Kuroki, Osaka (JP); Takashi Tamura, Osaka (JP); Hajime Sejima, Osaka (JP); Mikiya Kitagawa, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/090,410

(22) Filed: Apr. 4, 2016

(65) Prior Publication Data

US 2016/0289019 A1 Oct. 6, 2016

(30) Foreign Application Priority Data

Apr. 6, 2015 (JP) ..... 2015-077556

(51) Int. Cl.

| | |
|---|---|
| ***B65H 1/00*** | (2006.01) |
| ***B65H 1/26*** | (2006.01) |
| ***B65D 25/20*** | (2006.01) |
| ***G03G 15/00*** | (2006.01) |
| ***G03G 21/16*** | (2006.01) |
| *G09F 3/20* | (2006.01) |

(52) U.S. Cl.

CPC ..... *B65H 1/266* (2013.01); *B65D 25/205* (2013.01); *G03G 15/6502* (2013.01); *G03G 21/1619* (2013.01); *G03G 21/1633* (2013.01); *B65H 2405/115* (2013.01); *B65H 2405/12* (2013.01); *B65H 2407/44* (2013.01); *B65H 2511/10* (2013.01); *B65H 2511/416* (2013.01); *B65H 2551/20* (2013.01); *B65H 2551/29* (2013.01); *G09F 3/201* (2013.01)

(58) Field of Classification Search

CPC ..... B65H 1/266; B65H 2405/12; B65H 2405/115; B65H 2407/44; B65H 2511/416; B65H 2511/40; B65H 2511/10; B65H 2551/20; B65H 2551/23; B65H 2551/29; G09F 2003/0272; G09F 3/201; B65D 25/205

See application file for complete search history.

(56) References Cited

U.S. PATENT DOCUMENTS 6,959,507 B2 * 11/2005 Bazany ..... B65D 25/205 206/459.5
2010/0223823 A1 * 9/2010 Gordon ..... G09F 3/0289 40/316

FOREIGN PATENT DOCUMENTS

JP 2004331266 A 11/2004

* cited by examiner

*Primary Examiner* — Jeremy R Severson
(74) *Attorney, Agent, or Firm* — Alleman Hall Creaseman & Turtle LLP

(57) ABSTRACT

A sheet feed cassette is a sheet feed cassette in which a sheet is stored, the sheet feed cassette being mountable to and detachable from an image forming apparatus, the sheet feed cassette including a mounting portion and a cover. The mounting portion is formed so as to be recessed in a front surface of the sheet feed cassette. One or a plurality of information display members on which information concerning the sheet is described can be inserted to and pulled out from the mounting portion. The cover is capable of opening/closing relative to the mounting portion and has a surface flush with the front surface of the sheet feed cassette in a state where the cover is closed.

10 Claims, 11 Drawing Sheets

SHEET FEED CASSETTE AND IMAGE FORMING APPARATUS

INCORPORATION BY REFERENCE

This application is based upon and claims the benefit of priority from the corresponding Japanese Patent Application No. 2015-077556 filed on Apr. 6, 2015, the entire contents of which are incorporated herein by reference.

BACKGROUND

The present disclosure relates to a sheet feed cassette including an information display member on which information concerning a stored sheet is described, and an image forming apparatus including the sheet feed cassette.

An image forming apparatus such as a printer, a copying machine, or a multifunction peripheral includes a mountable/detachable sheet feed cassette in which sheets, such as paper sheets, on which an image is to be formed are stored. A mounting portion into which a display sheet on which information, such as the size and the sheet kind of the sheets, is described is inserted may be provided at the front surface of the sheet feed cassette.

SUMMARY

A sheet feed cassette according to one aspect of the present disclosure is a sheet feed cassette in which a sheet is stored, the sheet feed cassette being mountable to and detachable from an image forming apparatus, the sheet feed cassette including a mounting portion and a cover. The mounting portion is formed so as to be recessed in a front surface of the sheet feed cassette. One or a plurality of information display members on which information concerning the sheet is described can be inserted to and pulled out from the mounting portion. The cover is capable of opening/closing relative to the mounting portion and has a surface flush with the front surface of the sheet feed cassette in a state where the cover is closed.

An image forming apparatus according to another aspect of the present disclosure includes the sheet feed cassette and an image forming portion configured to form an image on the sheet supplied from the sheet feed cassette.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the accompanying drawings in order to allow understanding of the present disclosure. It should be noted that the following embodiment is an example embodying the present disclosure and does not limit the technical scope of the present disclosure.

[Schematic Configuration of Image Forming Apparatus 100]

Figure 1:
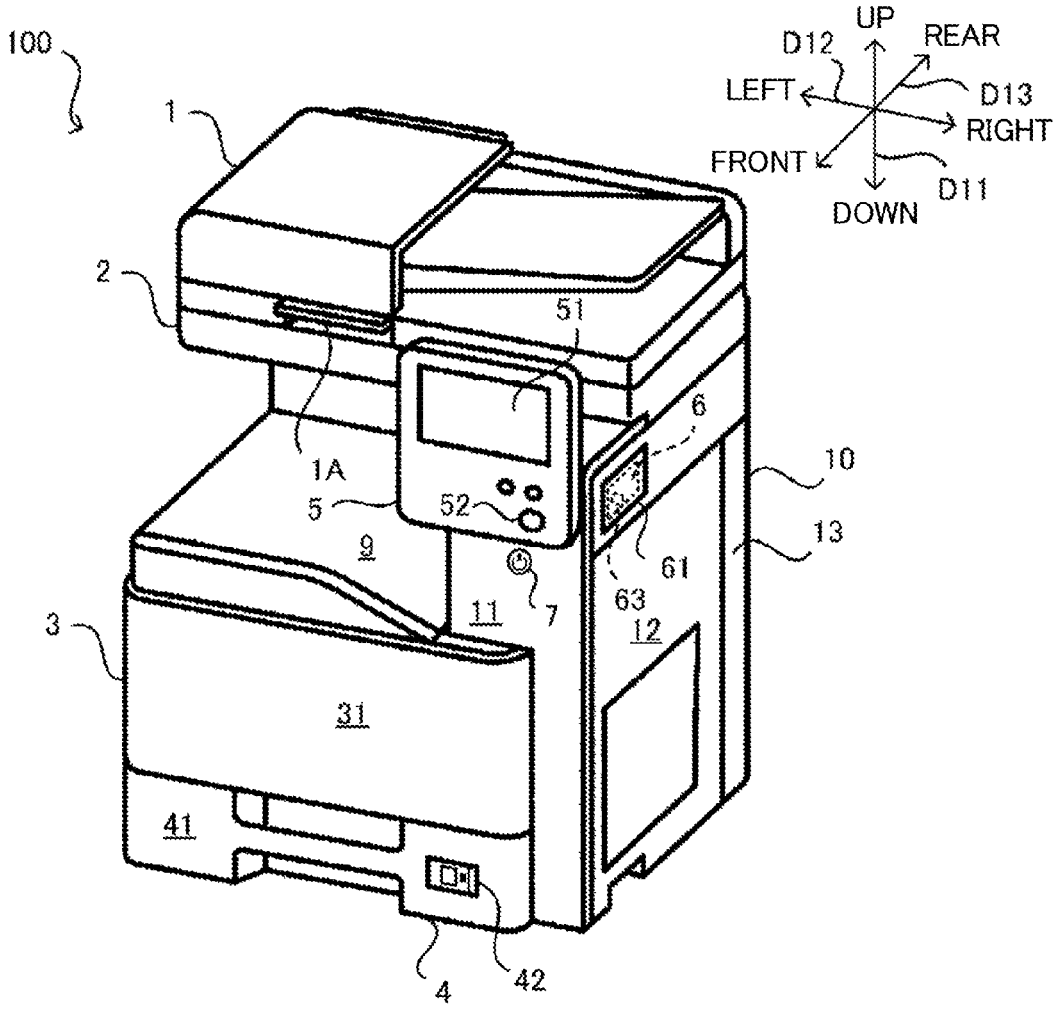
FIG. 1 is a perspective view of an image forming apparatus according to an embodiment of the present disclosure.
Figure 2:
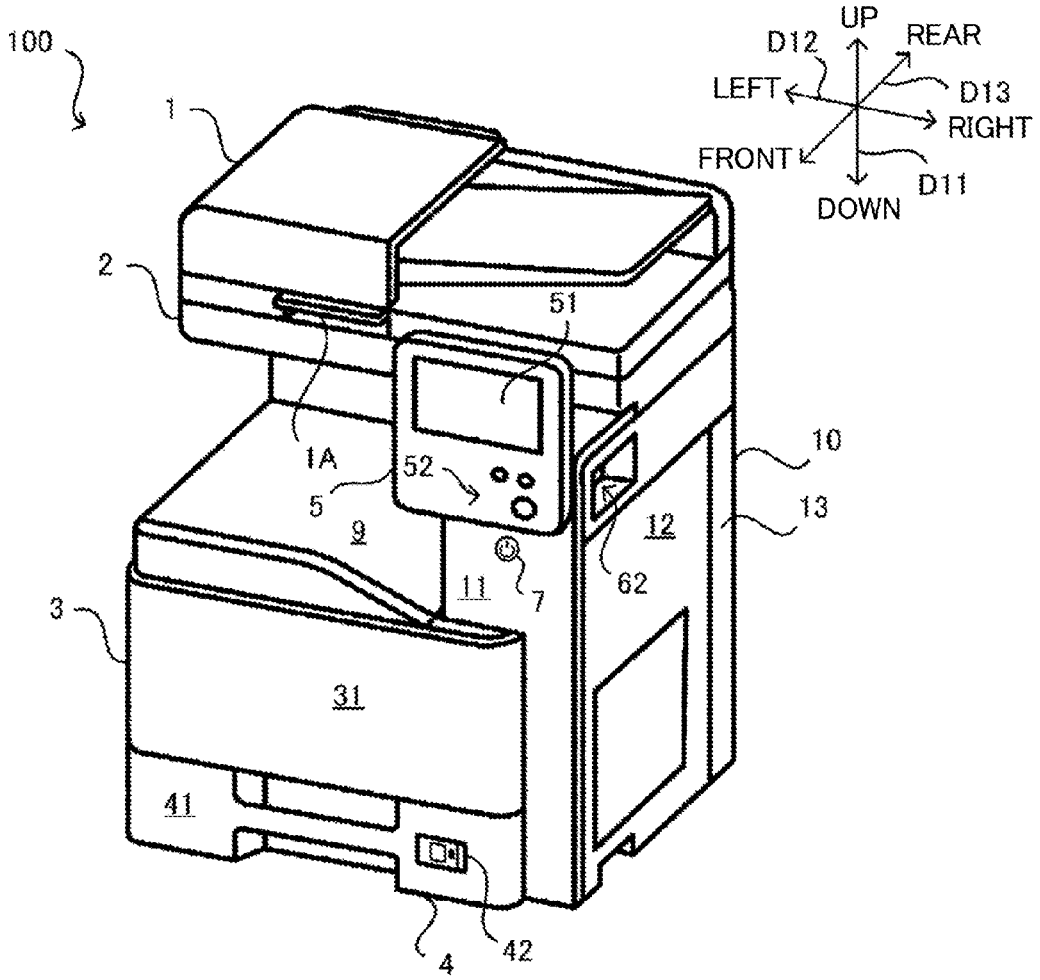
FIG. 2 is a perspective view of the image forming apparatus according to the embodiment of the present disclosure.
Figure 3:
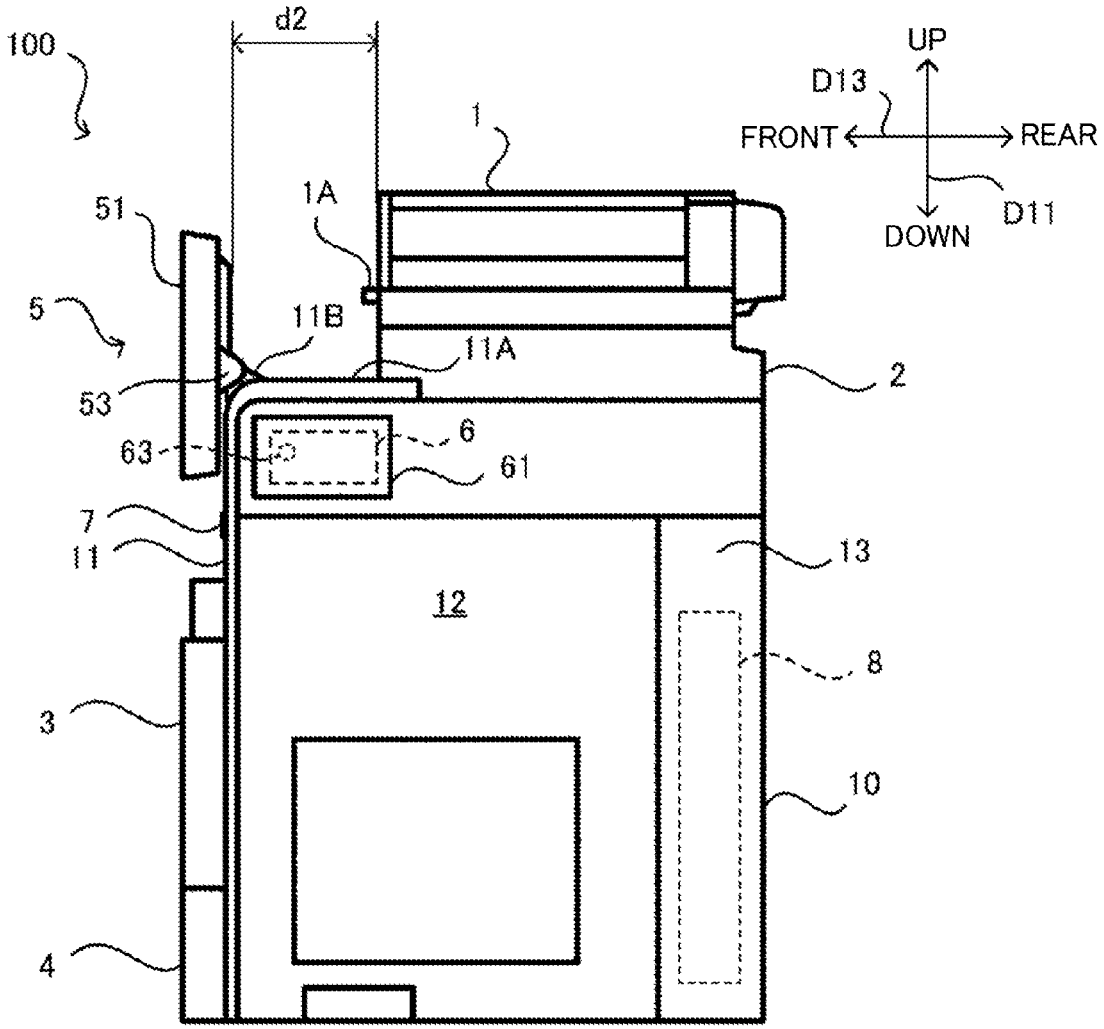
FIG. 3 is a right side view of the image forming apparatus according to the embodiment of the present disclosure.
Figure 4:
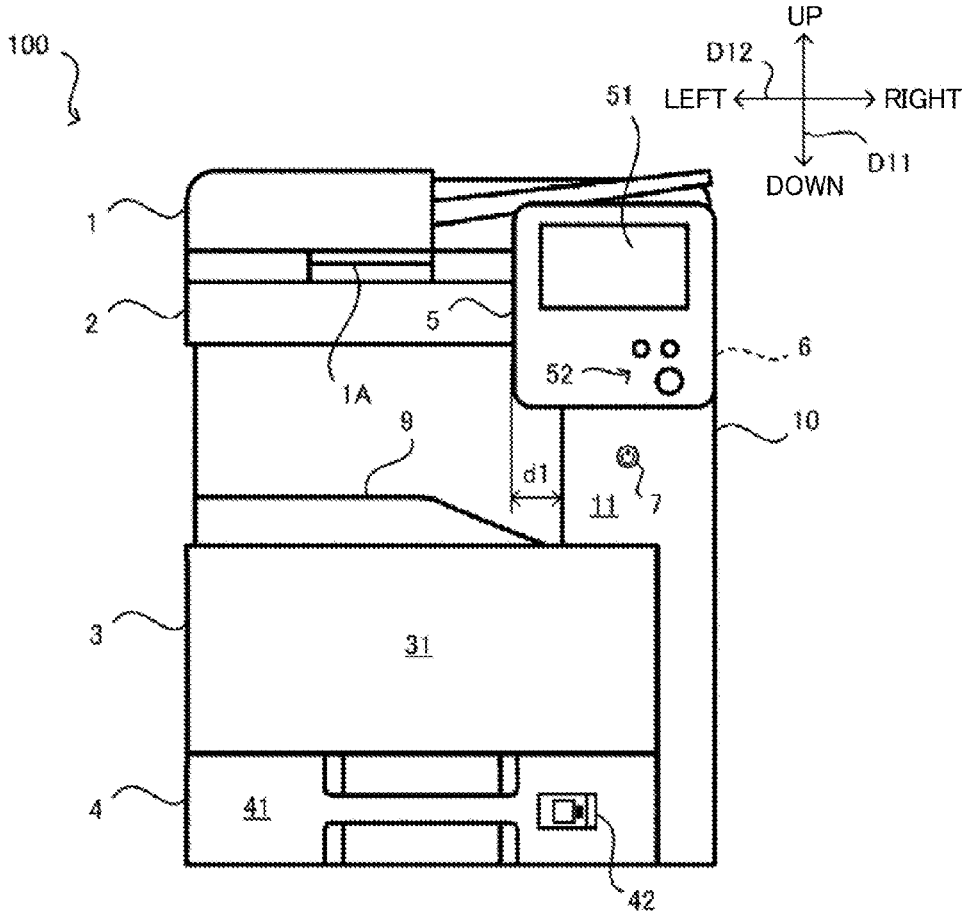
FIG. 4 is a front view of the image forming apparatus according to the embodiment of the present disclosure.

A schematic configuration of an image forming apparatus 100 according to the embodiment of the present disclosure will be described with reference to FIGS. 1 to 4. FIGS. 1 and 2 are perspective views of the image forming apparatus 100, FIG. 3 is a right side view of the image forming apparatus 100, and FIG. 4 is a front view of the image forming apparatus 100. In the following description, an up-down direction D11, a right-left direction D12, and a front-rear direction D13 that are shown in the respective drawings may be used.

The image forming apparatus 100 includes an ADF 1, an image reading portion 2, an image forming portion 3, a sheet feed cassette 4, an operation portion 5, an IC reader 6, a main power switch 7, a control portion 8, an in-body discharge portion 9, and a support housing 10, etc. The image forming apparatus 100 is a multifunction peripheral having a plurality of functions such as a scanning function to read image data from a document and a printing function to form an image on the basis of image data, as well as a facsimile function, a copy function, or the like.

The ADF 1 is an automatic document feeder that includes a document set portion, conveying rollers, a document holder, and a sheet discharge portion and conveys a document to be read by the image reading portion 2. The image reading portion 2 includes a document table, a light source, a mirror, an optical lens, and a charge coupled device (CCD), and is able to read an image from a document and output the read image as image data. The image reading portion 2 is disposed above the image forming portion 3, and the ADF 1 is disposed above the image reading portion 2. The ADF 1 is able to open/close relative to the image reading portion 2, and is provided with a grip portion 1A that is used by a user for an opening/closing operation of the ADF 1.

[Sheet Feed Cassette 4]

The sheet feed cassette 4 is mountable to and detachable from the image forming apparatus 100, and sheets that are to be supplied to the image forming portion 3 are stored in the sheet feed cassette 4. In addition, a cassette display portion 42 on which information regarding the sheets such as the size and the sheet kind of the sheets stored in the sheet feed cassette 4 is displayed is provided at a front surface 41 of the sheet feed cassette 4. Specifically, the cassette display portion 42 is disposed near a right end portion of the front surface 41 of the sheet feed cassette 4 and in a range corresponding to a position in the vertically downward direction from the operation portion 5. The cassette display portion 42 may be disposed near a left end portion of the front surface 41 of the sheet feed cassette 4.

Figure 5:
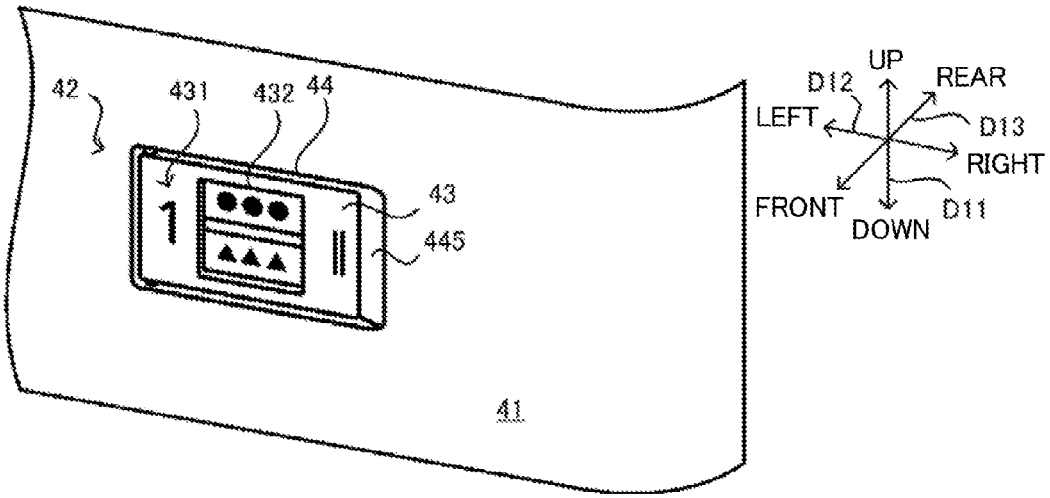
FIG. 5 is a perspective view showing a cassette display portion of the image forming apparatus according to the embodiment of the present disclosure.
Figure 6:
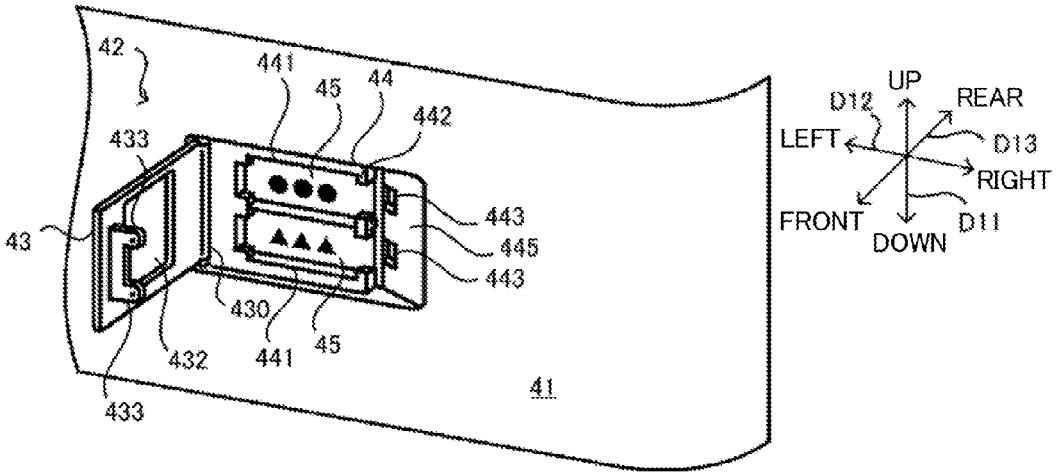
FIG. 6 is a perspective view showing the cassette display portion of the image forming apparatus according to the embodiment of the present disclosure.
Figure 7:
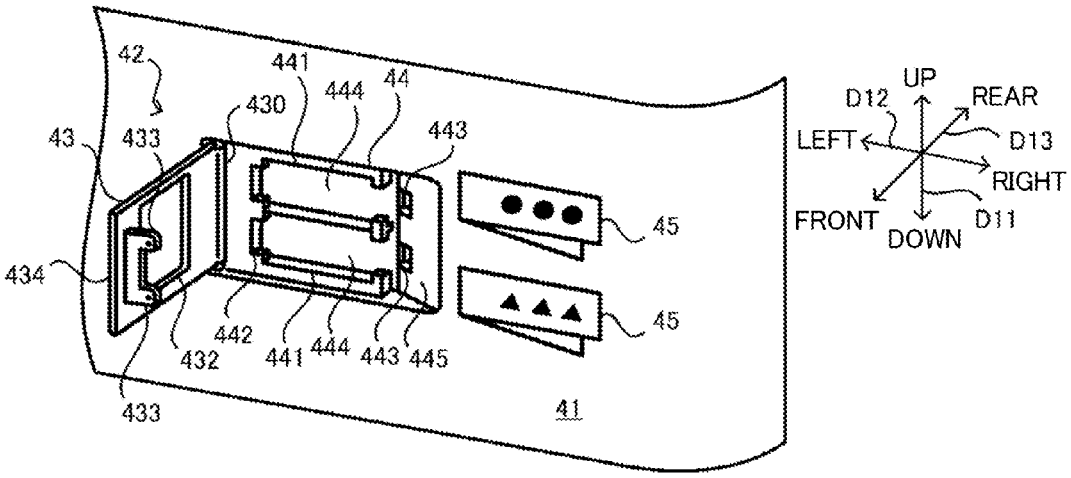
FIG. 7 is a perspective view showing the cassette display portion of the image forming apparatus according to the embodiment of the present disclosure.
Figure 8:
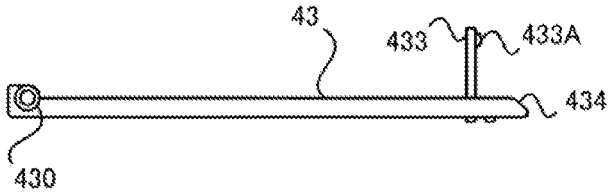
FIG. 8 is a diagram showing a cover of the cassette display portion of the image forming apparatus according to the embodiment of the present disclosure.

FIGS. 5 to 7 are perspective views showing a main part of the front surface 41 of the sheet feed cassette 4 including the cassette display portion 42, and FIG. 8 is a plan view of a cover 43. As shown in FIGS. 5 to 7, the cassette display portion 42 includes the cover 43, a mounting portion 44, and display sheets 45 (an example of information display members).

The cover 43 includes a rotation shaft 430, a stage number display portion 431, a window member 432, engagement portions 433, and an inclined surface 434. The rotation shaft 430 is a shaft parallel to the vertical direction, and the cover 43 is supported by the rotation shaft 430 so as to be able to open/close relative to the mounting portion 44. On the stage number display portion 431, a number indicating the number of a stage at which the sheet feed cassette 4 is used is described in advance.

The window member 432 is a light-transmitting acrylic resin through which the display sheets 45 inserted in the mounting portion 44 are viewable from the outside. The window member 432 of the cover 43 may be omitted, and an opening may be formed at the position corresponding to the window member 432 of the cover 43.

The engagement portions 433 maintain a closed state of the cover 43 by coming into engagement with later-described to-be-engaged portions 443 provided in the mounting portion 44. Specifically, as shown in FIG. 8, each engagement portion 433 includes a projection 433A, and maintains the closed state of the cover 43 by fitting the projection 433A to a to-be-fitted portion (recess portion) formed in the to-be-engaged portion 443. On the other hand, when the cover 43 is pulled out frontward, each engagement portion 433 bends, each projection 433A disengages from the to-be-fitted portion, and the cover 43 is opened.

Here, as shown in FIG. 8, the inclined surface 434 of the cover 43 is an end portion of the cover 43 at the upstream side in an insertion direction of the display sheets 45 to the mounting portion 44, and is formed at a position opposing an inclined surface 445 of the mounting portion 44. In addition, the inclined surface 434 is inclined in the same direction as the inclined surface 445 and more steeply than the inclined surface 445. Thus, the user is allowed to easily open the cover 43 by inserting their finger between the inclined surface 434 of the cover 43 and the inclined surface 445 of the mounting portion 44.

Meanwhile, in such a type of sheet feed cassette 4, when the mounting portion 44 into which the display sheets 45 are inserted is provided so as to project from the front surface 41 of the sheet feed cassette 4, irregularities occur on the front surface 41 of the sheet feed cassette 4. Thus, for example, a feeling of unity of the external appearance of the sheet feed cassette 4 or the image forming apparatus 100 may be impaired, or there is a possibility that a hand of the user or the like may be caught by the cassette display portion 42.

On the other hand, the front surface of the cover 43 is flush with the front surface 41 of the sheet feed cassette 4 in a state where the cover 43 is closed. That is, the front surface of the cover 43 and the front surface 41 of the sheet feed cassette 4 are flush with each other without having a step. Thus, occurrence of irregularities on the front surface 41 of the sheet feed cassette 4 due to the mounting portion 44 is suppressed. Therefore, as compared to the case where the cassette display portion 42 projects from the sheet feed cassette 4, a feeling of unity of the external appearance of the sheet feed cassette 4 or the image forming apparatus 100 is not impaired, and there is no possibility that the hand of the user or the like is caught by the cassette display portion 42.

The mounting portion 44 is formed so as to be recessed in the front surface 41 of the sheet feed cassette 4, and the display sheets 45 can be inserted into and pulled out from the mounting portion 44. That is, since the mounting portion 44 is a recess portion formed in the front surface 41 of the sheet feed cassette 4, and the front surface of the cover 43 is flush with the front surface 41 of the sheet feed cassette 4, the cassette display portion 42 does not project from the front surface 41. Specifically, the mounting portion 44 includes holding portions 441, projection portions 442, the to-be-engaged portions 443, holding surfaces 444, and the inclined surface 445. More specifically, two holding portions 441 are provided in the mounting portion 44 so as to be arranged vertically, and the two display sheets 45 can be mounted therein.

Each holding portion 441 has a gap between the holding surface 444 and the holding portion 441, and holds the display sheet 45 inserted into the gap, between the holding surface 444 and the holding portion 441. The projection portions 442 project inwardly from four corners of each holding portion 441 in order to prevent detachment of the display sheet 45 from the holding portion 441. Each to-be-engaged portion 443 is a recess portion formed in the inclined surface 445, and the to-be-fitted portion (recess portion) to which the engagement portion 433 of the cover 43 is to be fitted is also formed within the recess portion.

The inclined surface 445 is inclined at the upstream side with respect to the holding surfaces 444 in the insertion direction of the display sheets 45 and along the insertion direction so as to be recessed gradually from the front surface 41 of the sheet feed cassette 4 toward the holding surfaces 444. In the mounting portion 44, each display sheet 45 can be inserted from the inclined surface 445 into between the holding portion 441 and the holding surface 444 along a direction parallel to a longitudinal direction of the front surface 41 of the sheet feed cassette 4 (the right-left direction). Thus, the user is allowed to easily insert the display sheet 45 to the holding surface 44 by sliding the display sheet 45 from the inclined surface 445.

Each display sheet 45 is an elongated member having a plurality of display surfaces on which information concerning the sheets is described and that are connected in the insertion direction of the display sheets 45 to the mounting portion 44. For example, a plurality of sizes of sheets are described on one of the display sheets 45, and a plurality of sheet kinds such as the materials and colors of sheets are described on the other display sheet 45. Each display sheet 45 is, for example, synthetic paper produced with a synthetic resin as a principal material, but may be paper. In addition, the cover 43 may be provided for each of the holding portions 441 of the mounting portion 44.

As shown in FIG. 7, each display sheet 45 is inserted into the mounting portion 44 in a state where the display sheet 45 is folded one or more times in the insertion direction. Specifically, FIG. 7 shows an example of the case where each display sheet 45 is one that is inserted into the mounting portion 44 in a state of being folded once in the insertion direction. In this case, each display sheet 45 has the four display surfaces in total on the front and back sides.

In particular, the up-down direction of the information concerning the sheets described on the respective display surfaces of each display sheet 45 and the up-down direction of the sheet feed cassette 4 desirably coincide with each other in a state where the folded portion of the display sheet 45 is located at the downstream side in the insertion direction. Thus, by elasticity generated by the folded portion of the display sheet 45, a biasing force acts in a direction in which the display sheet 45 is moved toward the downstream side in the insertion direction to the mounting portion 44, so that detachment of the display sheet 45 from the mounting portion 44 is suppressed.

[Image Forming Portion 3]

The image forming portion 3 is an electrophotographic type image forming portion that forms an image on the sheet supplied from the sheet feed cassette 4, on the basis of image data read by the image reading portion 2 or image data inputted from an external information processing apparatus. Specifically, the image forming portion 3 includes a photosensitive drum, a charging device, a laser scanning unit (LSU), a developing device, a transfer roller, a cleaning device, and a fixing roller, etc.

As shown in FIG. 1, the image forming portion 3 is disposed below the image reading portion 2, and the in-body discharge portion 9 is disposed between the image reading portion 2 and the image forming portion 3 in the vertical direction. The sheet on which an image has been formed by the image forming portion 3 is discharged to the in-body discharge portion 9. The image forming portion 3 includes a cover member 31 that covers the front of the image forming portion 3 and is able to open/close, and the cover member 31 is opened and closed, for example, when a toner cartridge is replaced.

In the image forming apparatus 100, the front of the in-body discharge portion 9 is opened, and the user takes out the sheet in the in-body discharge portion 9 from the front of the image forming apparatus 100. Here, in the image forming apparatus 100, as shown in FIG. 4, the length of a front panel 11 of the support housing 10 in the right-left direction D12 is shorter than that of the operation portion 5 by a length d1 in a front view of the image forming apparatus 100. Thus, for example, the user easily views the interior of the in-body discharge portion 9 in a state of a low attitude where the user sits on a wheelchair or the like. The front panel 11 of the support housing 10 is provided between the image reading portion 2 and the image forming portion 3 and forms a part of a housing front surface of the image forming apparatus 100.

[Operation Portion 5]

The operation portion 5 is disposed at a position frontward of the image reading portion 2 and above the cover member 31, and includes a touch panel 51 and operation buttons 52 that receive user operations. The touch panel 51 includes a display portion, such as a liquid crystal display, which displays various kinds of information such as an operation screen, and receives a user operation on the display portion. The operation buttons 52 include hardware keys such as a start key. In addition, the operation portion 5 includes a rotation shaft 53 parallel to the right-left direction D12 of the image forming apparatus 100, and a rotation support portion 11B that rotatably supports the rotation shaft 53 is provided on an upper surface 11A of the front panel 11 of the support housing 10. Thus, the operation portion 5 is supported at a position frontward of the image reading portion 2 by the rotation shaft 53, which is parallel to the right-left direction D12 of the image forming apparatus 100, so as to be rotatable within a predetermined rotation range.

Here, the rotation shaft 53 is provided at the position of substantially the center between the upper end and the lower end of the operation portion 5. Thus, the operation portion 5 is rotatable about a position inward of the upper end and the lower end of the operation portion 5. The position of the rotation shaft 53 is not limited to the center between the upper end and the lower end of the operation portion 5, and the rotation shaft 53 only needs to be located at a position inward of the upper end and the lower end.

Figure 9:
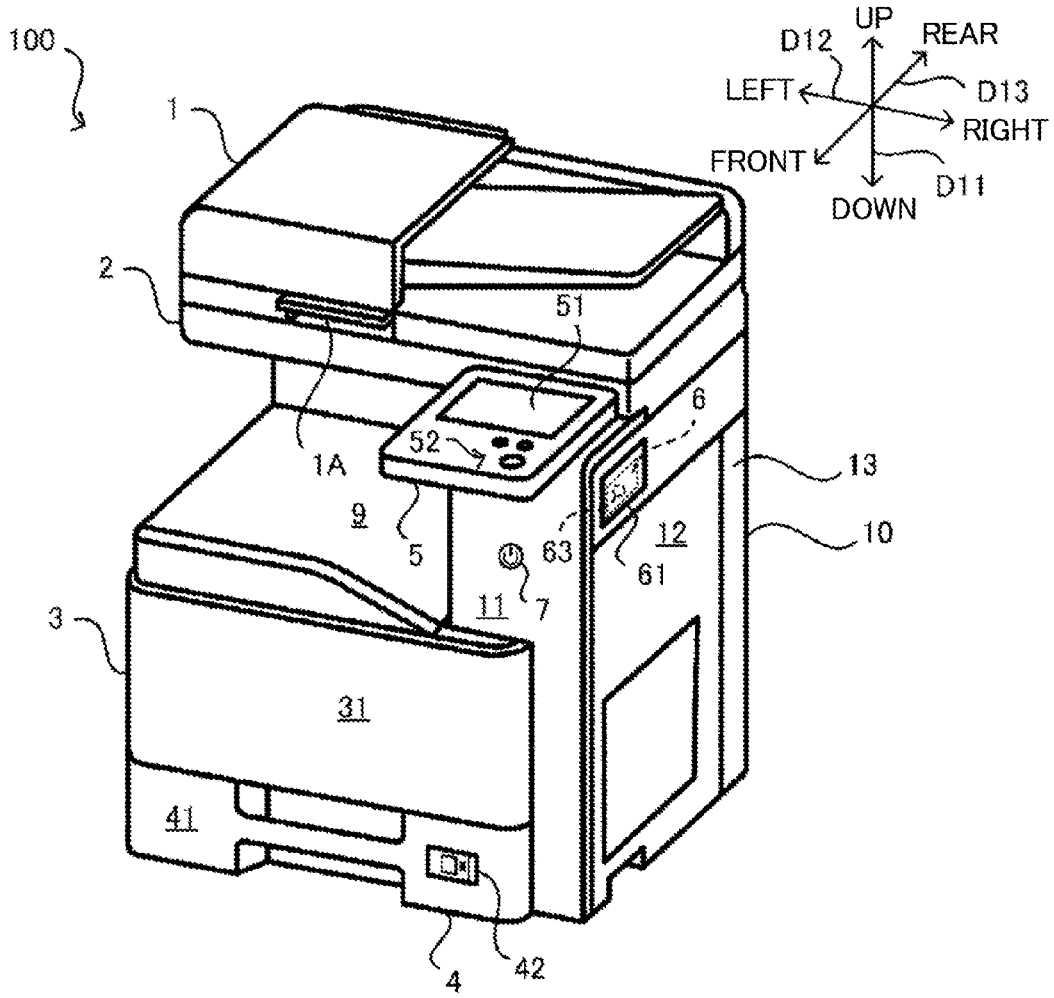
FIG. 9 is a perspective view of the image forming apparatus according to the embodiment of the present disclosure.
Figure 10:
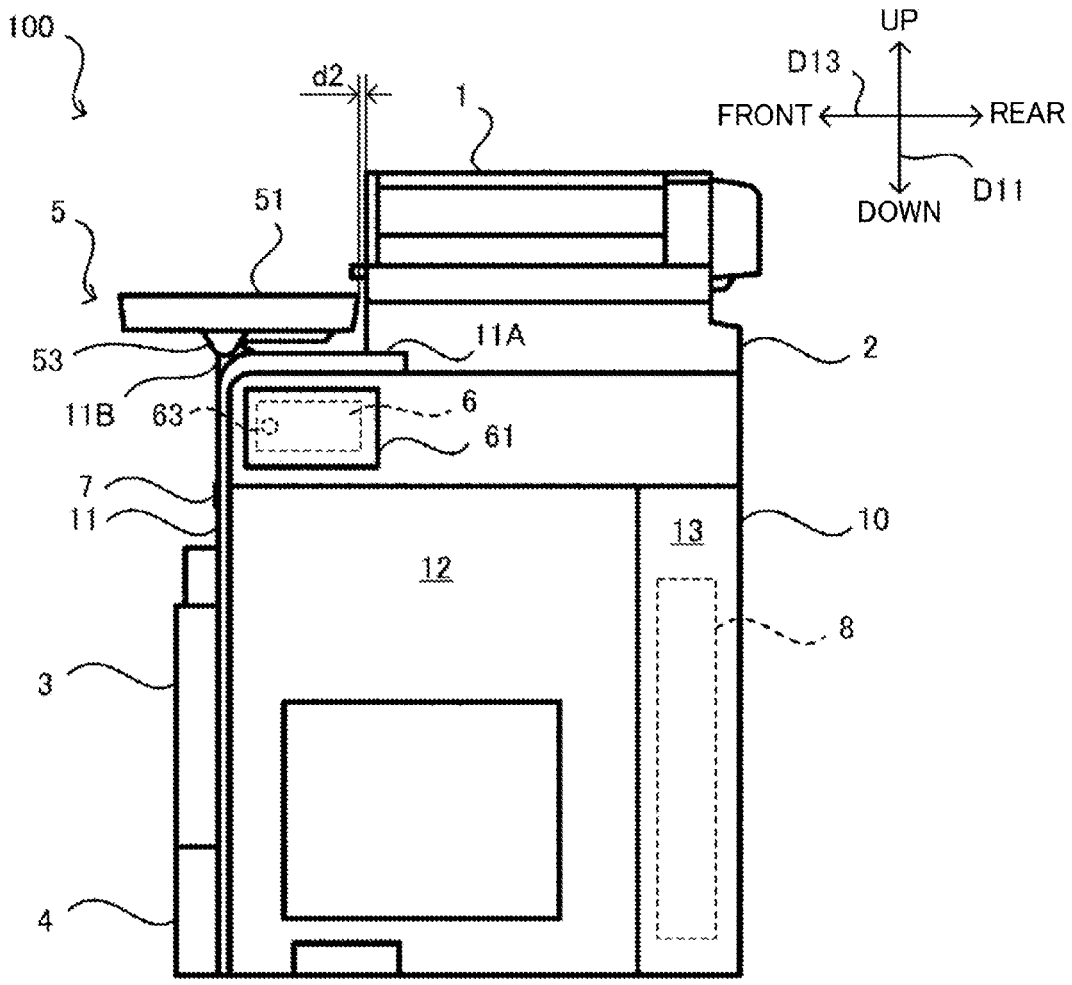
FIG. 10 is a right side view of the image forming apparatus according to the embodiment of the present disclosure.
Figure 11:
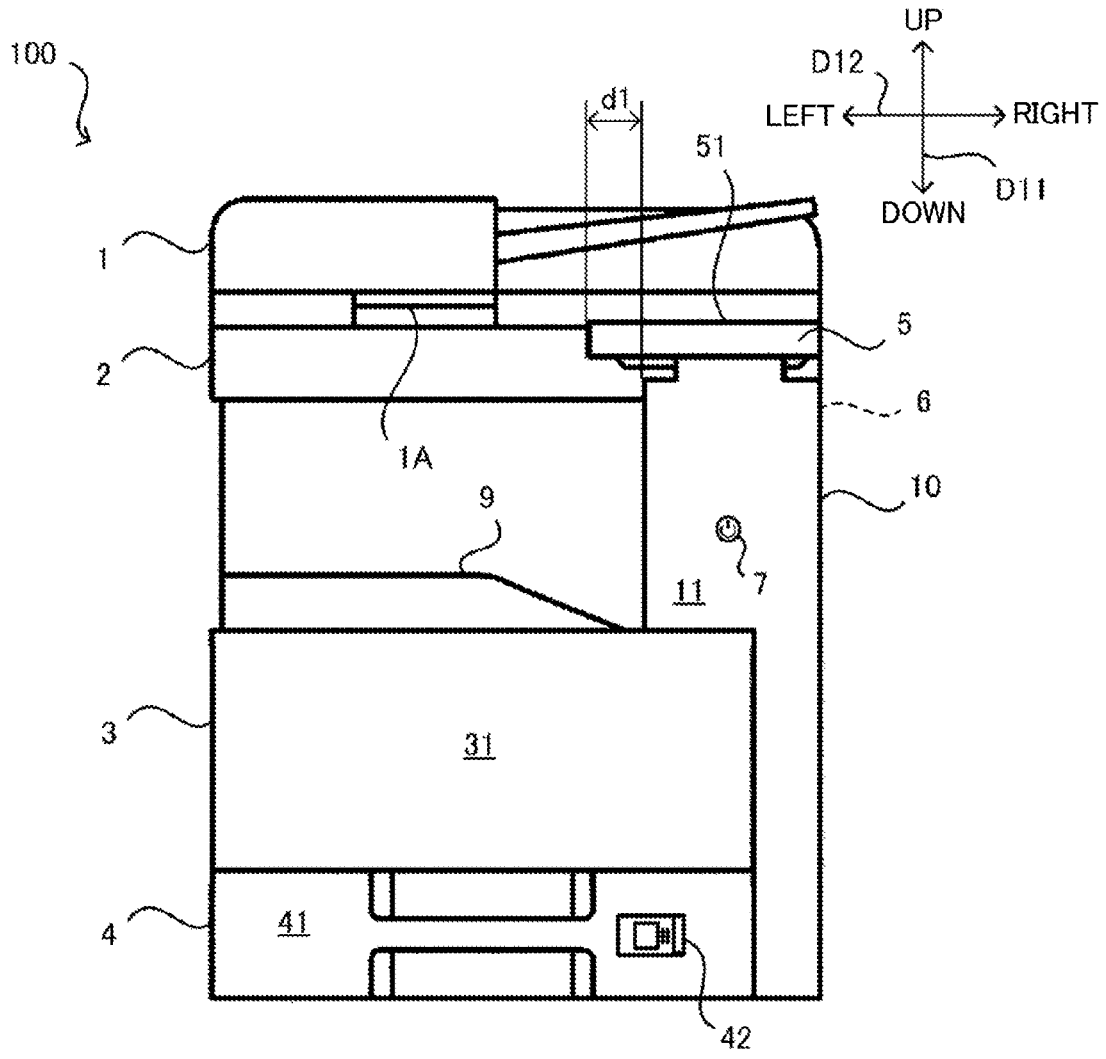
FIG. 11 is a front view of the image forming apparatus according to the embodiment of the present disclosure.
Figure 12:
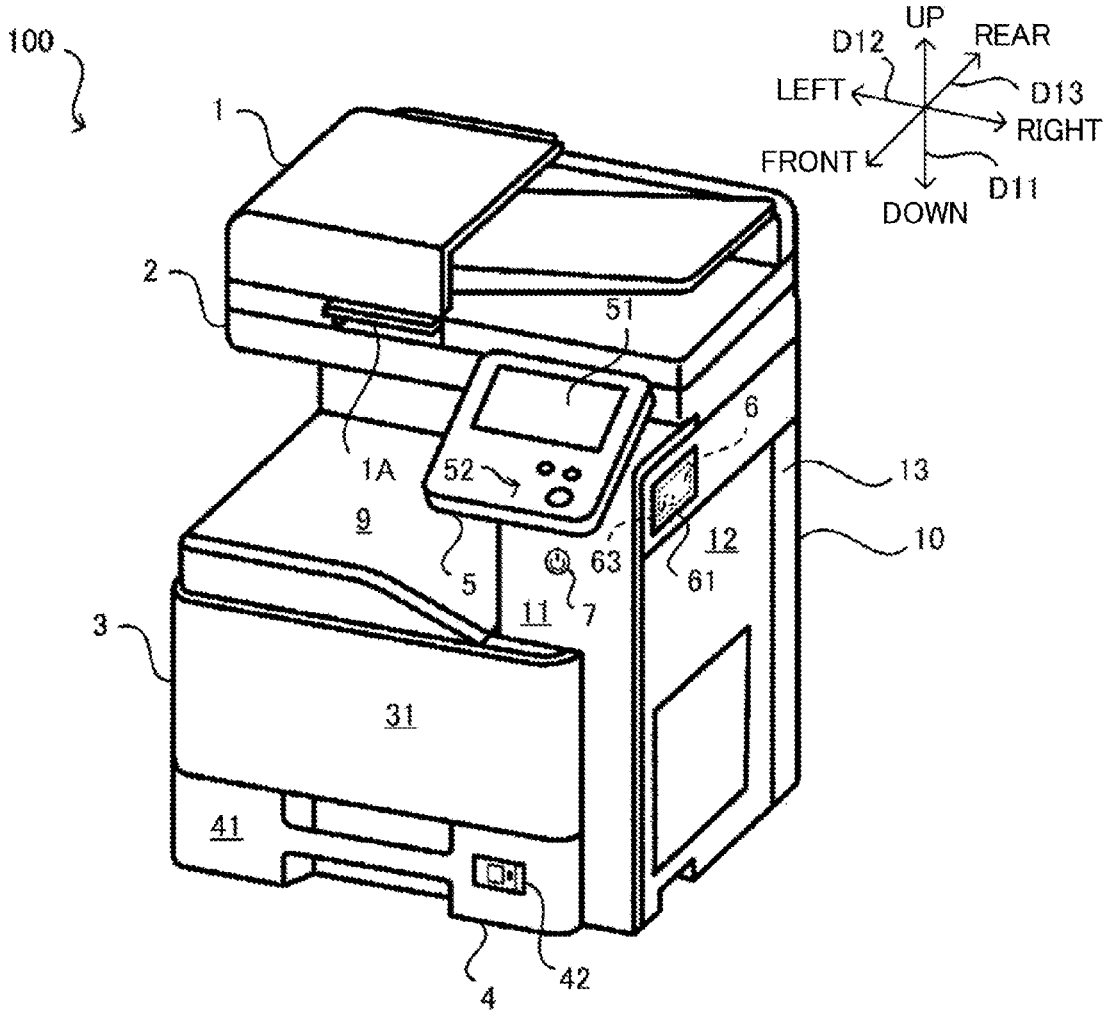
FIG. 12 is a perspective view of the image forming apparatus according to the embodiment of the present disclosure.
Figure 13:
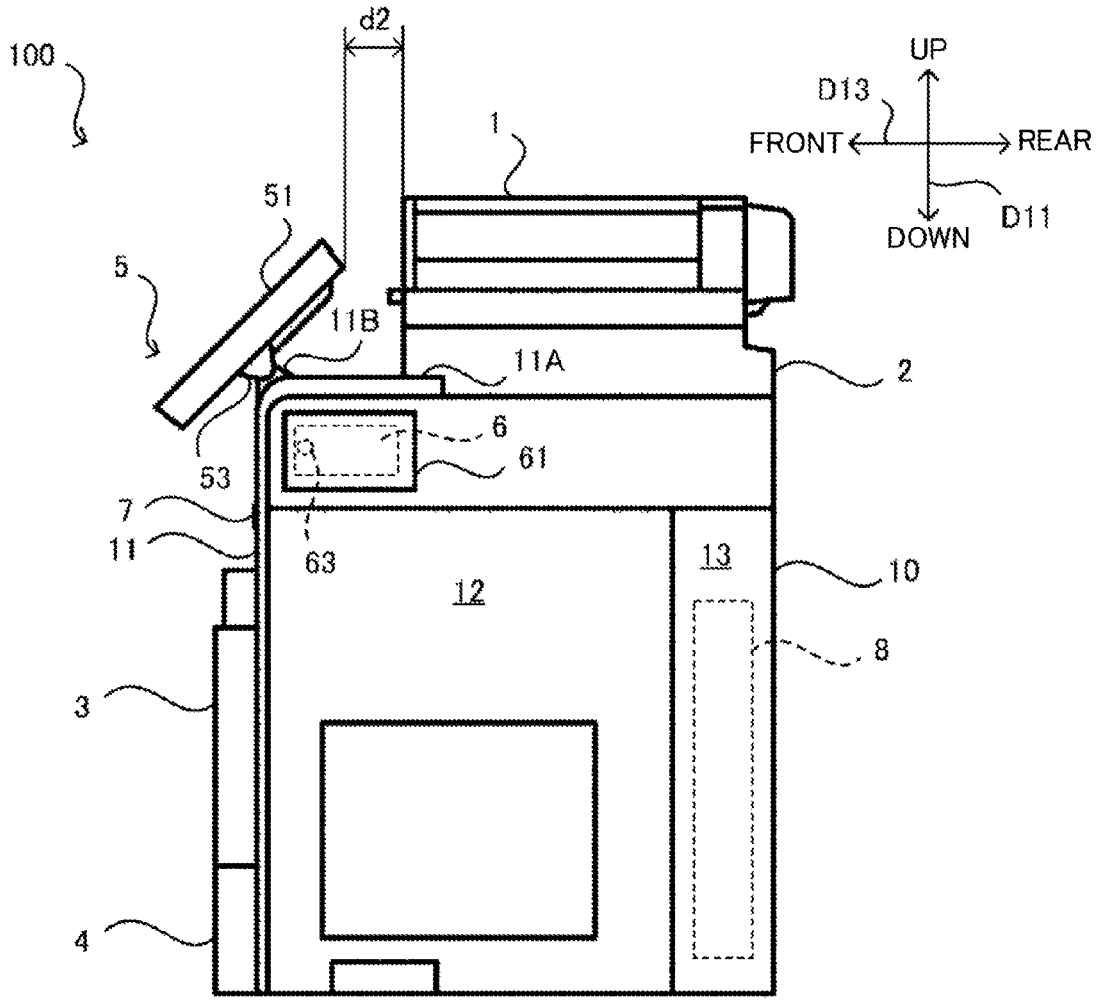
FIG. 13 is a right side view of the image forming apparatus according to the embodiment of the present disclosure.
Figure 14:
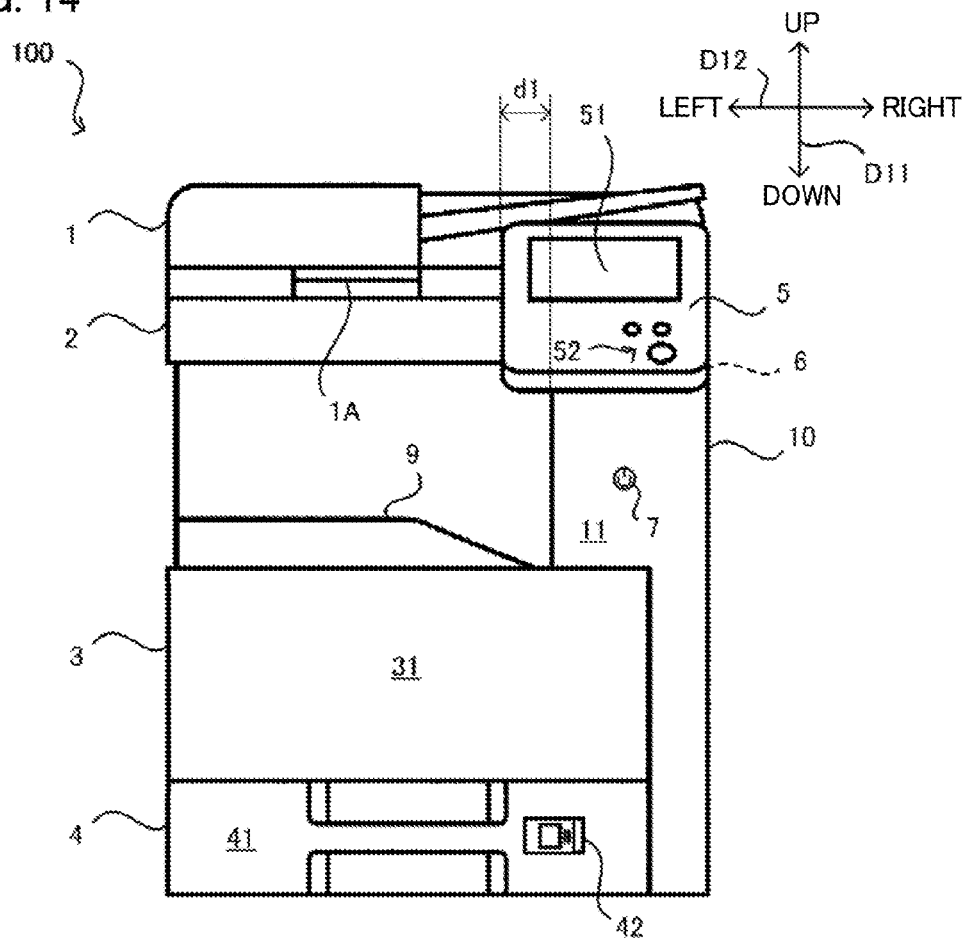
FIG. 14 is a front view of the image forming apparatus according to the embodiment of the present disclosure.

More specifically, the operation portion 5 is rotated between a first attitude (specific attitude) in which the front surface of the operation portion 5 (the surface of the touch panel 51) is parallel to a vertical plane as shown in FIGS. 1 to 4 and a second attitude in which the front surface of the operation portion 5 is parallel to a horizontal plane as shown in FIGS. 9 to 11. In addition, the operation portion 5 is able to maintain its attitude at any position between the first attitude and the second attitude. For example, FIGS. 12 to 14 show a state where the front surface of the operation portion 5 is inclined at 45 degrees relative to the horizontal plane.

That is, in the image forming apparatus 100, the operation portion 5 is rotatable within a rotation range of 90 degrees between the first attitude and the second attitude. In this case, in the image forming apparatus 100, a region that is located rearward of the operation portion 5 when the operation portion 5 is in the first attitude and that is located below the operation portion 5 when the operation portion 5 is in the second attitude, is present inward of the front panel 11. Thus, as described later, in the image forming apparatus 100, the IC reader 6 is disposed by using this region.

The first attitude and the second attitude are not limited to the above. For example, the first attitude may be a state where the front surface of the operation portion 5 is slightly inclined relative to the vertical plane, or a state where the front surface of the operation portion 5 is inclined, for example, at about 15 degrees relative to the vertical plane. Similarly, the second attitude may be a state where the front surface of the operation portion 5 is slightly inclined relative to the horizontal plane, or a state where the front surface of the operation portion 5 is inclined, for example, at about 15 degrees relative to the horizontal plane.

As shown in FIG. 3, in the image forming apparatus 100, the front surface of the operation portion 5 in the first attitude is flush with either one of or both the front surface of the cover member 31 of the image forming portion 3 and the front surface 41 of the sheet feed cassette 4. In the image forming apparatus 100, it is conceivable that either one of or both the cover member 31 and the sheet feed cassette 4 projects outward of the operation portion 5 in the first attitude. According to such a configuration, for example, during conveyance of the image forming apparatus 100, since the operation portion 5 in the first attitude does not project from the image forming portion 3 and the sheet feed cassette 4, it is possible to suppress damage of the operation portion 5.

In the image forming apparatus 100, as shown in FIG. 3, when the operation portion 5 is in the first attitude, a gap d2 is formed between the back surface of the operation portion 5 and the image reading portion 2 in a side view. Thus, for example, even when the operation portion 5 is used in an attitude as shown in FIG. 13, the user who stands in front of the image forming apparatus 100 can view the in-body discharge portion 9 through the gap d2 between the back surface of the operation portion 5 and the image reading portion 2 from above. In particular, as described above, in a front view of the image forming apparatus 100, since the length of the front panel 11 of the support housing 10 in the right-left direction D12 is shorter than that of the operation portion 5 by the length d1, the viewable range of the in-body discharge portion 9 is widened.

[IC Reader 6]

The IC reader 6 is able to read information concerning the user via non-contact communication from an IC card carried by the user. Specifically, when the user stands at the front side of the image forming apparatus 100 and causes the IC reader 6 to read the carried IC card, the user logs into the image forming apparatus 100 and starts using the image forming apparatus 100. A log-in process for the user is performed by the control portion 8. In the present embodiment, the IC reader 6 is an example of an information reading portion, and the IC card is an example of a storage medium. Instead of the IC reader 6, an information reading portion such as a fingerprint verification portion that reads information concerning the fingerprint of the user may be provided in another embodiment.

As shown in FIGS. 1 and 3, the IC reader 6 is housed in a right side surface 12 (an example of a housing side surface) of the support housing 10, and the surface of the IC reader 6 is covered with a light-transmitting reading cover 61. The surface of the reading cover 61 is flush with the right side surface 12 of the support housing 10. That is, the surface of the reading cover 61 of the IC reader 6 and the right side surface 12 of the support housing 10 are flush with each other without having a step. Therefore, the external appearance of the image forming apparatus 100 is not impaired, and there is no possibility that the user contacts the IC reader 6 and the reading cover 61.

Meanwhile, after causing the IC reader 6 to read the carried IC card, the user of the image forming apparatus 100 performs an operation by using the operation portion 5. As described above, at the time of start of use of the image forming apparatus 100, a predetermined series of user operations are performed. At this time, as the distance between the positions of the IC reader 6 and the operation portion 5 is larger, a required operation range for the user is wider. On the other hand, in the image forming apparatus 100, the IC reader 6 and the operation portion 5 are disposed such that a required operation range when the IC reader 6 and the operation portion 5 are used by the user is narrow.

Specifically, in the image forming apparatus 100, the IC reader 6 is disposed in a region where: a part of the IC reader 6 is present rearward of the operation portion 5 in the first attitude in which the front surface of the operation portion 5 is closest to the vertical plane; and a part of the IC reader 6 is present below the operation portion 5 in the second attitude in which the front surface of the operation portion 5 is closest to the horizontal plane. In this manner, in the image forming apparatus 100, the space, inward of the front panel 11, which occurs due to the configuration in which the operation portion 5 is rotatable in the rotation range between the first attitude and the second attitude by the rotation shaft 53 provided inward of the upper end and the lower end thereof, is used as a region for disposing the IC reader 6.

Thus, in the image forming apparatus 100, the IC reader 6 is disposed near the operation portion 5, so that the required operation range when the user operates the operation portion 5 after causing the IC reader 6 to read the IC card, is narrow.

FIG. 2 is a perspective view of the image forming apparatus 100 and shows a state where the reading cover 61 and the IC reader 6 are removed. As shown in FIG. 2, an IC holder 62 is formed in the right side surface 12 of the support housing 10, and the IC reader 6 is held by the IC holder 62. The IC reader 6 and the IC holder 62 are hidden when the reading cover 61 is attached to the right side surface 12.

The IC reader 6 includes a lighting portion 63, such as an LED, which is used for displaying an operation state of the IC reader 6, etc. The lighting portion 63 lights up in green when the information is normally read from the IC card by the IC reader 6, and lights up in red when the information is not normally read from the IC card by the IC reader 6. Meanwhile, the reading cover 61 is a light-transmitting smoked cover having gray color or black color, and a lighting state of the lighting portion 63 can be visually recognized from the outside through the reading cover 61.

[Main Power Switch 7]

The main power switch 7 is an operation button for turning on/off the main power of the image forming apparatus 100. Specifically, the main power switch 7 is used for turning on or off all the functions of the image forming apparatus 100 including the copy function, the printing function, the scanning function, and the facsimile function.

For example, in the image forming apparatus 100, a transformer is provided in a power supply portion (not shown) that converts power supplied from a commercial AC power supply. The main power switch 7 is a push type switch or a seesaw type switch that switches between establishment and blocking of a power path connected to the secondary side of the transformer that is provided in the power supply portion. Thus, presence/absence of supply of power to various circuits connected to the secondary side of the transformer in the image forming apparatus 100 is switched by the main power switch 7.

Meanwhile, in the image forming apparatus 100, in addition to the main power switch 7, a power saving key (not shown) for shifting to and cancelling a power saving mode in which some functions such as the facsimile function of the image forming apparatus 100 are kept on and the other functions are turned off, may be provided. For example, the power saving key is provided in the operation portion 5, and the image forming apparatus 100 shifts to the power saving mode through an operation of the power saving key.

Incidentally, in a configuration in which the main power switch 7 is disposed on the front panel 11 directly below the operation portion 5, the operability by the user improves, but there is a problem that the main power switch 7 is easily recognized by the user. On the other hand, in the image forming apparatus 100, the main power switch 7 is disposed in consideration of balance between the operability of the main power switch 7 and the viewability of the main power switch 7 by the user.

Specifically, the main power switch 7 is disposed at a position that is between the operation portion 5 in the first attitude and the cover member 31 of the image forming portion 3 and retracted rearward of the front surface of the operation portion 5 in the first attitude and the front surface of the cover member 31. More specifically, in the image forming apparatus 100, the front panel 11 of the support housing 10 is provided between the operation portion 5 in the first attitude and the cover member 31 of the image forming portion 3, and is retracted rearward of the front surface of the operation portion 5 in the first attitude and the front surface of the cover member 31. The main power switch 7 is disposed on the front panel 11 and at a position between the lower end of the operation portion 5 in the first attitude and the upper end of the cover member 31 of the image forming portion 3.

Thus, the main power switch 7 and the operation portion 5 are provided closely to each other, and the required operation range for the user is narrow. Meanwhile, since the main power switch 7 is disposed on the front panel 11 that is retracted rearward of the operation portion 5 and the image forming portion 3, the main power switch 7 becoming excessively conspicuous is suppressed.

In particular, as shown in FIG. 4, in a state where the operation portion 5 is in the first attitude, the touch panel 51, the operation buttons 52, and the main power switch 7 are disposed in order of the touch panel 51, the operation buttons 52, and the main power switch 7 from the vertically upward direction toward the vertically downward direction. Thus, the operation buttons 52 and the main power switch 7 on which user operations are performed are disposed in a concentrated manner at positions close to each other, so that the operability by the user improves.

[Control Portion 8]

As shown in FIG. 3, the control portion 8 is disposed within a control box 13 at the back surface side of the side surface 12 of the image forming apparatus 100. The control portion 8 includes control devices such as a CPU, a ROM, and a RAM that are not shown. The CPU is a processor that performs various calculation processes. The ROM is a non-volatile storage portion in which information such as a control program for causing the CPU to perform various processes is stored in advance. The RAM is a volatile storage portion used as a temporary storage memory (working area) for various processes performed by the CPU. The control portion 8 performs various processes, using the CPU, in accordance with various control programs stored in advance in the ROM.

Specifically, the control portion 8 reads an image of a document, using the image reading portion 2, by performing a preset image reading process. In addition, the control portion 8 forms an image on the sheet, using the image forming portion 3, by performing a preset image forming process. Furthermore, the control portion 8 performs a display control process of controlling the contents displayed on the touch panel 51 provided in the operation portion 5.

Figure 15:
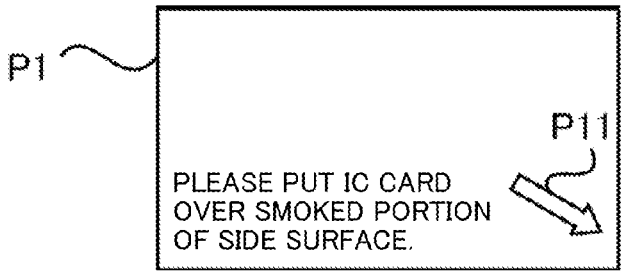
FIG. 15 is a diagram showing an example of a display screen in the image forming apparatus according to the embodiment of the present disclosure.
Figure 16:
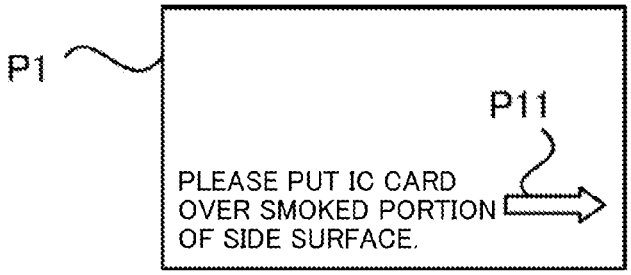
FIG. 16 is a diagram showing an example of the display screen in the image forming apparatus according to the embodiment of the present disclosure.

Specifically, in a state where the user has not logged into the image forming apparatus 100, if the touch panel 51 of the operation portion 5 is touched by the user, the control portion 8 displays, on the touch panel 51, a display screen P1 for prompting reading of the IC card by the IC reader 6. FIGS. 15 and 16 are diagrams each showing an example of the display screen P1. FIG. 15 is a display example of the display screen P1 when the operation portion 5 is in the first attitude, and FIG. 16 is a display example of the display screen P1 when the operation portion 5 is in the second attitude.

As shown in FIGS. 15 and 16, the control portion 8 displays, on the display screen P1 of the touch panel 51 of the operation portion 5, a message indicating that it is necessary to cause the IC card to be read, and also a position guide image P11 as a position guide for the IC reader 6. The control portion 8 changes the content of the position guide in accordance with a rotation state of the operation portion 5. An inclination detection sensor (not shown) is provided in the operation portion 5, and a rotation state of the operation portion 5 detected by the inclination detection sensor is inputted to the control portion 8.

Specifically, when the operation portion 5 is in the first attitude, the IC reader 6 is present in the lower right direction as seen from the touch panel 51. Thus, as shown in FIG. 15, the control portion 8 displays, as the position guide image P11, a figure of an arrow indicating the lower right direction. On the other hand, when the operation portion 5 is in the second attitude, the IC reader 6 is present in the right direction as seen from the touch panel 51. Thus, as shown in FIG. 16, the control portion 8 displays, as the position guide image P11, a figure of an arrow indicating the right direction. Accordingly, the position of the IC reader 6 can be clearly suggested to the user in accordance with rotation of the operation portion 5.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet feed cassette in which a sheet to be supplied to an image forming apparatus is stored, the sheet feed cassette being mountable to and detachable from the image forming apparatus, the sheet feed cassette comprising:

a mounting portion integrally formed with the sheet feed cassette so as to be recessed in a front surface of the sheet feed cassette and into and from which one or a plurality of information display members on which information concerning the sheet is described can be inserted and pulled out; and a cover capable of opening/closing relative to the mounting portion and having a surface flush with the front surface of the sheet feed cassette in a state where the cover is closed, wherein the mounting portion has: a holding surface on which each information display member is held; and an inclined surface that is recessed at an upstream side with respect to the holding surface in an insertion direction of the information display members and along the insertion direction gradually toward the holding surface.

2. The sheet feed cassette according to claim 1, wherein the mounting portion is configured such that each information display member can be inserted thereinto and pulled out therefrom along a direction parallel to a longitudinal direction of the front surface of the sheet feed cassette.

3. The sheet feed cassette according to claim 2, wherein each information display member is an elongated member having a plurality of display surfaces on which different information concerning the sheet is described and that are connected in the insertion direction of the information display members to the mounting portion; and each information display member is inserted into the mounting portion in a state where the information display member is folded one or more times in the insertion direction.

4. The sheet feed cassette according to claim 3, wherein each information display member is inserted into the mounting portion in a state where the information display member is folded once in the insertion direction; and an up-down direction of the information concerning the sheet described on each display surface and an up-down direction of the sheet feed cassette coincide with each other in a state where a folded portion of the information display member is located at a downstream side in the insertion direction.

5. The sheet feed cassette according to claim 1, wherein the information concerning the sheet includes either one of or both a size of the sheet and a sheet kind of the sheet.

6. The image forming apparatus comprising:

the sheet feed cassette according to claim 1; and an image forming portion configured to form an image on the sheet supplied from the sheet feed cassette.

7. The image forming apparatus according to claim 6, further comprising an operation portion configured to receive a user operation, wherein the mounting portion is disposed in the front surface of the sheet feed cassette and in a range corresponding to a position in a vertically downward direction from the operation portion.

8. The sheet feed cassette according to claim 1, wherein the mounting portion includes a holding portion and a projection portion;

the holding portion has a gap between the holding surface and the holding portion, and holds each information display member inserted into the gap, between the holding surface and the holding portion; and the projection portion projects inwardly from the holding portion so as to prevent detachment of each information display member.

9. A sheet feed cassette in which a sheet is stored, the sheet feed cassette being mountable to and detachable from an image forming apparatus, the sheet feed cassette comprising:

a mounting portion formed so as to be recessed in a front surface of the sheet feed cassette and into and from which one or a plurality of information display members on which information concerning the sheet is described can be inserted and pulled out; and a cover capable of opening/closing relative to the mounting portion and having a surface flush with the front surface of the sheet feed cassette in a state where the cover is closed, wherein the mounting portion has a holding surface on which each information display member is held, and an inclined surface that is recessed at an upstream side with respect to the holding surface in an insertion direction of the information display members and along the insertion direction gradually toward the holding surface; and the cover has an inclination that is formed at a position corresponding to the inclined surface of the mounting portion and is inclined in the same direction as the inclined surface and more steeply than the inclined surface.

10. A sheet feed cassette in which a sheet to be supplied to an image forming apparatus is stored, the sheet feed cassette being mountable to and detachable from the image forming apparatus, the sheet feed cassette comprising:

a mounting portion integrally formed with the sheet feed cassette so as to be recessed in a front surface of the sheet feed cassette and into and from which one or a plurality of information display members on which information concerning the sheet is described can be inserted and pulled out; and a cover capable of opening/closing relative to the mounting portion and having a surface flush with the front surface of the sheet feed cassette in a state where the cover is closed, wherein the cover includes a rotation shaft and an engagement portion;

the rotation shaft supports one of opposite ends of the cover such that the cover can be opened and closed relative to the mounting portion;

the engagement portion maintains a closed state of the other of the opposite ends of the cover; and the mounting portion includes a to-be-engaged portion to which the engagement portion is fitted.

* * * * *